US011680460B2

(12) United States Patent
Newton

(10) Patent No.: US 11,680,460 B2
(45) Date of Patent: Jun. 20, 2023

(54) SURFACE DEPLOYED ANNULAR SAFETY VALVE

(71) Applicant: Halliburton Energy Services, Inc., Houston, TX (US)

(72) Inventor: Daniel Newton, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/392,765

(22) Filed: Aug. 3, 2021

(65) Prior Publication Data

US 2023/0037547 A1 Feb. 9, 2023

(51) Int. Cl.

| | |
|---|---|
| ***E21B 34/02*** | (2006.01) |
| ***E21B 17/02*** | (2006.01) |
| ***E21B 34/16*** | (2006.01) |

(52) U.S. Cl.

CPC ..... *E21B 34/02* (2013.01); *E21B 17/0283* (2020.05); *E21B 34/16* (2013.01)

(58) Field of Classification Search

CPC .... E21B 17/0283; E21B 17/028; E21B 34/02; E21B 34/025; E21B 34/16

See application file for complete search history.

(56) References Cited

U.S. PATENT DOCUMENTS

| | | | |
|---|---|---|---|
| 6,662,875 | B2 | 12/2003 | Bass et al. |
| 8,684,073 | B2 | 4/2014 | Sevheim et al. |
| 9,500,062 | B2 | 11/2016 | Tveiten et al. |
| 10,138,724 | B2 | 11/2018 | Querales et al. |
| 2010/0025045 | A1 | 2/2010 | Lake et al. |
| 2014/0060803 | A1 | 3/2014 | Gano |
| 2020/0308925 | A1 | 10/2020 | Pivowar et al. |

FOREIGN PATENT DOCUMENTS

| | | |
|---|---|---|
| CA | 2985020 | 11/2016 |
| EP | 2529078 B1 | 9/2017 |
| NO | 317533 | 11/2004 |
| WO | 2020247460 A1 | 12/2020 |

OTHER PUBLICATIONS

Halliburton, "Artificial Lift Integrated Solutions", 2019, 4 pages.
Halliburton, "DataSphere Linx Monitoring System, B-Annulus Pressure—Temperature Monitoring", 2017, 2 pages.
Halliburton, "EcoStar Electric Tubing Retrievable Safety Valve", 2020, 2 pages.
Halliburton, "HS Auto-Gas Lift Valve", 2015, 1 page.
Halliburton, "Otis RPT No-Go Landing Nipple and Lock Mandrel System", 2017, 2 pages.
Halliburton, "Otis X and XN Landing Nipples and Lock Mandrels", 2017, 2 pages.
Halliburton, "Surface Annular Safety Systems, PCT Product Catalogue 1116ST", 2020, 1 page.
International Application, International Search Report and Written Opinion, PCT/US2021/047322, dated Apr. 27, 2022, 10 pages.

*Primary Examiner* — Kristyn A Hall
(74) *Attorney, Agent, or Firm* — Kilpatrick Townsend & Stockton LLP

(57) ABSTRACT

A well system may include a tubing string positioned downhole in a wellbore defining an annulus between the tubing string and a wellbore. An annular safety valve may be positioned at the surface of the wellbore for controlling a passage of gas through the annular safety valve into the annulus. The annular safety valve may include an inductive coupler that is coupled to a power source at the surface via a power line for powering the annular safety valve.

20 Claims, 17 Drawing Sheets

SURFACE DEPLOYED ANNULAR SAFETY VALVE

TECHNICAL FIELD

The present disclosure relates generally to an annular safety valve (ASV) that can be deployed at a surface of a wellbore, and more particularly to an electrically powered ASV.

BACKGROUND

An ASV may be part of a completion string that is positionable downhole in a wellbore, in some cases the ASV may be deployed at a surface of a wellbore. The ASV may be utilized to control the annulus contents during shut-in operations. The ASV may be hydraulically controlled by a hydraulic control line connecting the ASV to a surface of the wellbore. The ASV may only be able to contain the annular contents of the wellbore to the depth or location at which the ASV is deployed. A seal or mechanical failure of the ASV may result in pressure or fluid transmission in the hydraulic control line. In some instances, such as when the ASV is deployed downhole within the wellbore, removing or repairing elements of the ASV may require removal of a well completion in the wellbore. When the ASV is hydraulically controlled, a retrievable surface deployed hydraulically operated system may be utilized to remove the ASV from deployment downhole within the wellbore. During remediation, the retrievable surface deployed hydraulically operated ASV system may expose the hydraulic operating line and may incur damage through blockage, provide a source for pressure of fluid transmission, or lose hydraulic control fluid. Hydraulic control systems may also have challenges or cost impacts through hydraulic pressure ratings of surface systems, associated hydraulic power (pushing force) for the actuation system, potential leak paths and limited feedback or monitoring of tool function. Electric control systems may overcome many of these challenges, however typical retrievable electrically controlled systems may require the use of electrical wet connects. Electrical wet connects may be a source of failure due to the complexity of use and susceptibility to harsh environments.

DETAILED DESCRIPTION

Certain aspects and examples of the present disclosure relate to an annular safety valve (ASV). In some aspects, the ASV may be deployed at the surface and may be powered via an electric coupling to an electrical power source. In some aspects, the ASV may be deployed as part of a wellhead system and installed within or in-line to the annulus outlet. An ASV may be utilized to ensure that in the event of an operational or safety requirement at surface the pressure in the annulus is contained by the closed ASV and that the pressure or fluid does not escape from the annulus. Remediation of the ASV may not require removal of the well completion but may be performed instead by removing the ASV via a lubricator system attached to the wellhead annulus outlet. The ASV may be provided electrical power through an inductive coupler that is in electrical communication with a power source at a surface of the wellbore. The electrical connection between the ASV and the power source at the surface may also provide for communicating data (e.g. diagnostic data or data collected by sensors) from the ASV to the surface of the wellbore. The power source may provide power to the ASV to drive a motor within the ASV that controls the position of a valve. The valve may actuate between an open and a closed position to allow or prevent the flow of gas pumped through the ASV into the wellbore. In some aspects, the valve may actuate between various open positions to control an amount of flow of gas into the wellbore through the ASV so as to operate as an annulus choke. The ASV may be easily retrieved for repair, replacement, or other purposes without the use of electrical wet connects. Moreover, the ASV may be remediated without the removal of the well completion.

The valve in the ASV may be configured to isolate the annulus in a variety of forms such that when the valve is in the open position it allows fluid passage in or out of the annulus, and when the valve is in the closed position the fluid and pressure in the annulus are isolated. The valve may be fail safe closed, such that a failure of the ASV may cause the valve to move to the closed position. In some aspects, the ASV may be configured to control an amount the valve opens to control an amount of fluid passage from a gas line injection choke into the annulus of the wellbore for use with a gas lift system.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Figure 1:
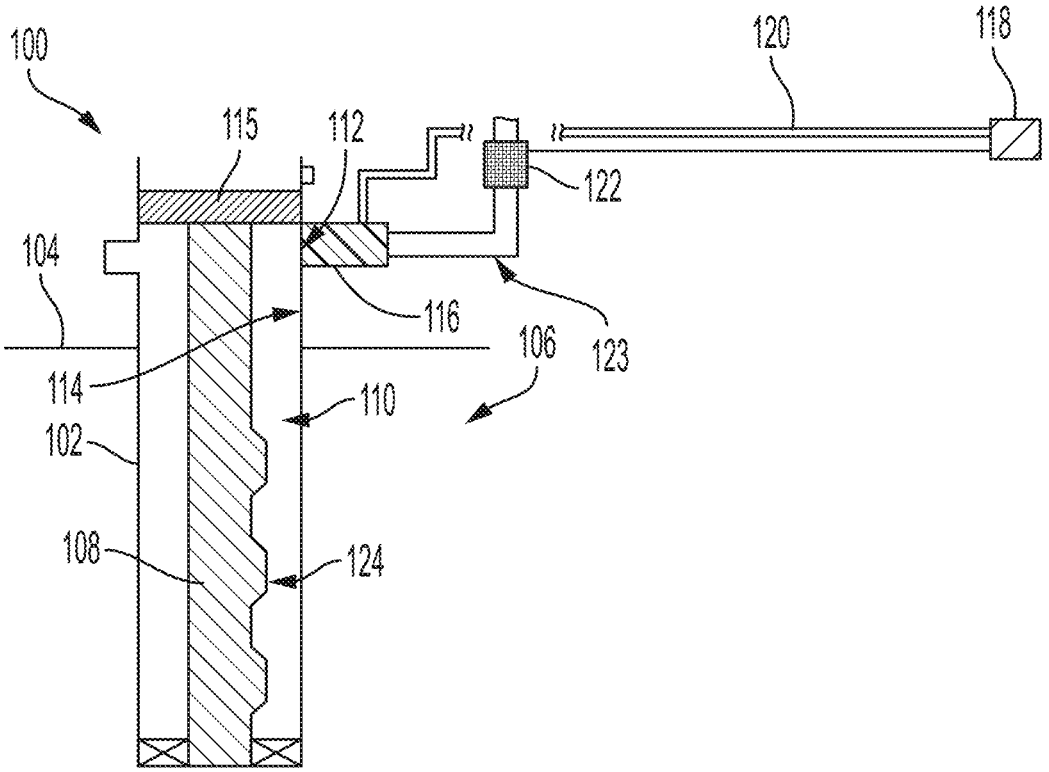
FIG. 1 is a schematic illustration of a well system including an annular safety valve (ASV) according to an aspect of the present disclosure.

FIG. 1 is a schematic illustration of a well system 100 according to an aspect of the present disclosure. The well system 100 includes a borehole that is a wellbore 102 extending through a surface 104 and various earth strata 106. A tubing string 108 may be positioned downhole in the wellbore 102. The tubing string 108 may be, for example, a casing string. An annulus 110 may be present between the wellbore 102 and the tubing string 108. The well system 100 may include an annulus outlet 112 at a wellhead 114. The wellhead 114 may be mechanically connected to the tubing string 108 via a tubing hanger 115 and may seal pressure in the annulus 110. An annular safety valve (ASV) 116 can be installed in the annulus outlet 112, in some aspects the ASV 116 may be installed in-line to the annulus outlet 112. A control unit 118 on the surface 104 may provide power via an electric line 120 to the ASV 116. In some aspects, the control unit 118 may also provide power via the electric line 120 to a gas line injection choke 122 located on the surface 104. The gas line injection choke 122 may control the flow of gas in gas lift modules 124 positioned downhole in the wellbore 102.

In some examples, the ASV 116 may provide a communication path in the annulus 110 between the tubing string 108 and the wellbore 102 (shown in FIG. 1). The ASV 116 may have an open position to allow gas from the gas line injection choke 122 to flow through a gas line injection 123 into the wellbore 102. The ASV 116 may have a closed position to prevent gas or liquid from the annulus to flow into the gas line injection 123. The ASV 116 is an electric annular safety valve that is powered by electricity provided by the control unit 118. As shown in FIG. 1, the ASV 116 may be positioned or deployed at the wellhead 114, for example but not limited to, within or in-line to the annulus outlet 112. In other aspects, the ASV 116 may be positioned within the wellbore 102 below the surface 104.

Figure 2A:
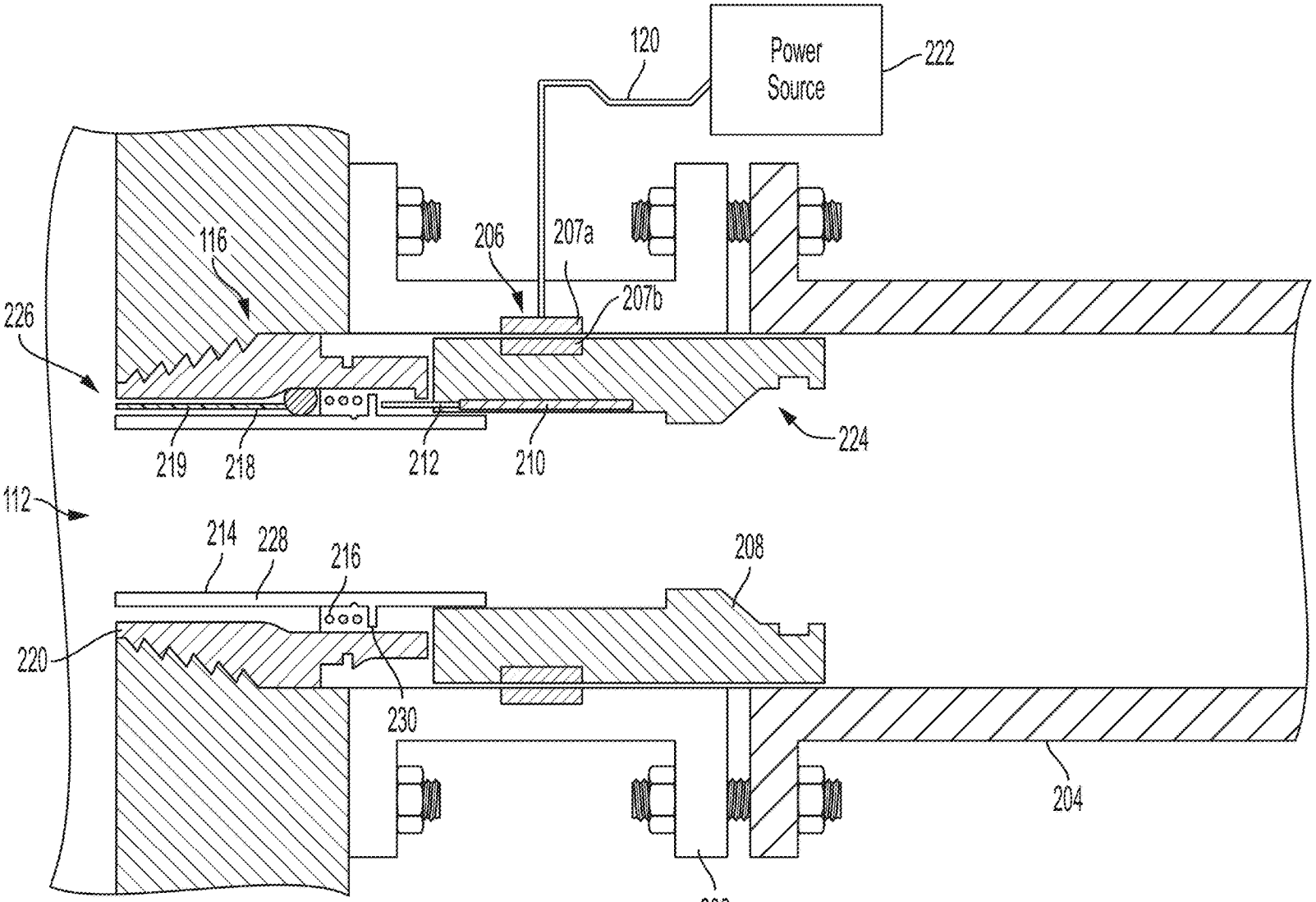
FIG. 2A is a schematic view of the ASV of FIG. 1 in an open position in the annulus outlet according to an aspect of the present disclosure.

FIG. 2A is a schematic view of the ASV 116, in an open position. The ASV 116 is positioned in the annulus outlet 112. In some examples, the ASV 116 may be located fully or partially within a casing spool 202 as shown in FIG. 2A. Alternatively, the ASV 116 may be located elsewhere at the wellhead in-line with the annulus outlet 112. In the open position, the ASV 116 may allow for gas to flow through the ASV 116. As shown in FIG. 2A, the ASV 116 may be coupled to a power source 222 via an inductive coupler 206 and an electric line 120. In some examples, the power source 222 can be the control unit 118 for the gas line injection choke 122, while in other cases a separate power source may be provided. As depicted in FIG. 2A, the inductive coupler 206 may have a first inductive coupler component 207*a* located on the casing spool 202 and a second inductive coupler component 207*b* located on the actuator housing 208.

The ASV 116 includes an actuator assembly 224 and a valve assembly 226. The actuator assembly 224 may include an actuator housing 208 that houses a motor or linear actuator 210 and an actuator arm 212. The motor or linear actuator 210 may be an electric motor (e.g. an electric linear motor) powered by the power source 222 at the surface of the wellbore 102 via the inductive coupler 206 and electric line 120. The motor or linear actuator 210 may actuate or move the actuator arm 212 for actuating the valve assembly 226 between an open position and a closed position. Alternatively, the actuator arm 212 may be operated directly by or be a part of an electrically driven liner actuator. The valve assembly 226 may include a valve housing 220 that houses a valve flow tube 214, a spring 216, and a valve 218. The valve 218 may include a flapper 219, as shown in FIG. 2A, though in some aspects the valve 218 may include a ball valve or other suitable valve feature. The valve flow tube 214 includes a tube body 228 and a projection 230. The projection 230 of the valve flow tube 214 may extend from the tube body 228 and may be positioned between a first end of the spring 216 and the actuator arm 212.

The valve housing 220 may be coupled to the other components of the valve assembly 226, thus retaining the other components of the valve assembly 226 in place. Because the valve assembly 226 is held in place in the wellbore 102, the actuator assembly 224 may be separated or retrieved from the ASV 116 while maintaining a barrier between the surface 104 and gas in the wellbore 102. This may allow the annulus contents to remain in place in the event that the annulus line 204 or spool 202 are damaged or removed through impact or the line contents are vented for operational reasons.

Figure 2B:
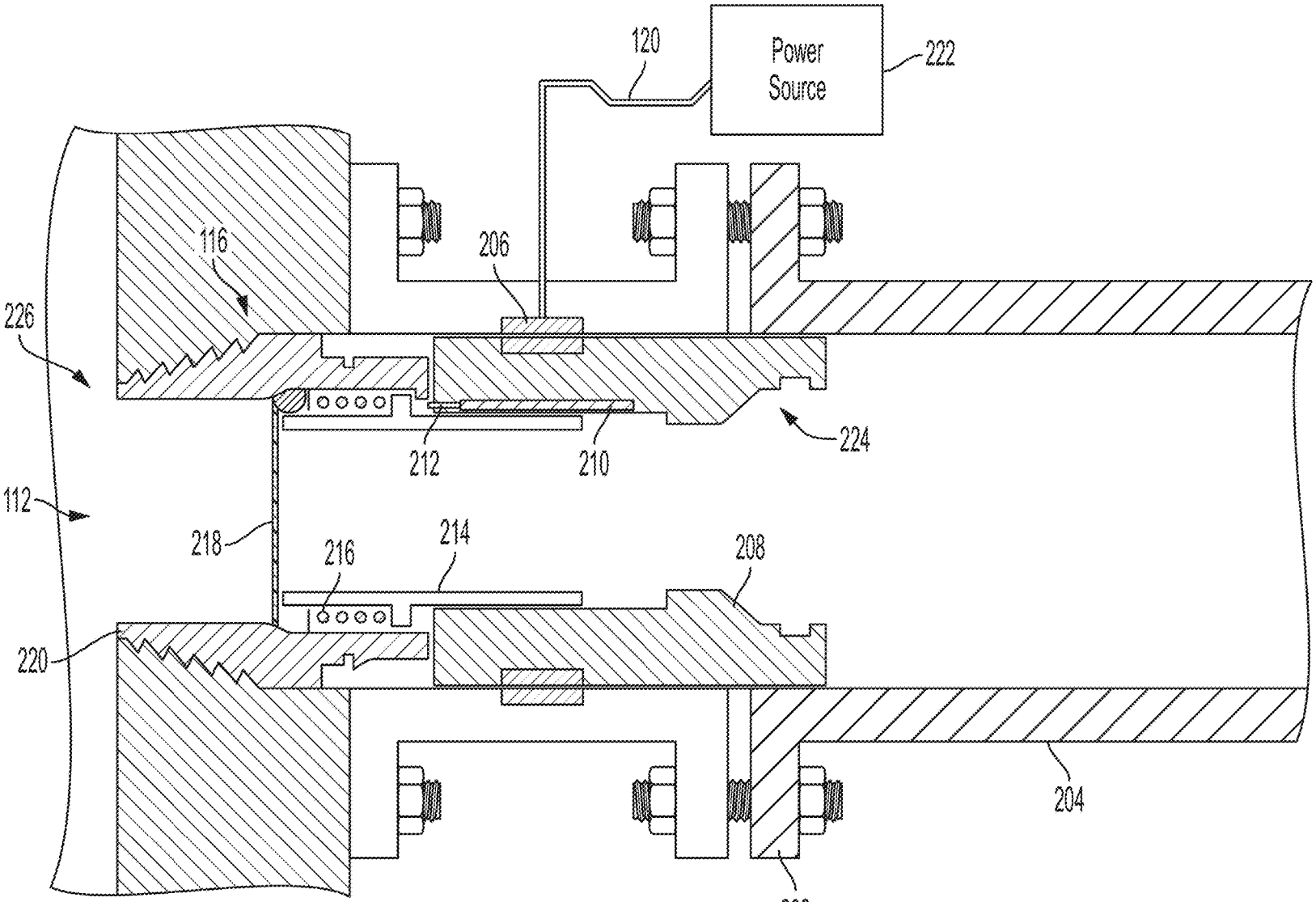
FIG. 2B is a schematic view of the ASV of FIG. 2A in a closed position according to an aspect of the present disclosure.

As shown in FIGS. 2A-2B, electrical power from the power source 222 can be transferred via the electric line 120 to the inductive coupler 206. Power can then be transferred by the inductive coupler 206 to the ASV 116 via inductive coupling. Power can be transferred by the inductive coupler 206 to the motor or linear actuator 210 of the actuator assembly 224. Via the power provided from the inductive coupler 206, the motor or linear actuator 210 can cause the actuator arm 212 to extend in a first direction towards the projection 230. In response to the motor or linear actuator 210 moving the actuator arm 212 in the first direction, the actuator arm 212 contacts the projection 230 applying a force in the first direction towards the spring 216. The force of the actuator arm 212 on the projection 230 may force the valve flow tube 214 in the first direction, compressing the spring 216. The compression of the spring 216 and the movement of the valve flow tube 214 actuates or moves the valve 218 from the closed position (shown in FIG. 2B) to the open position (shown in FIG. 2A) in which gas may flow from the surface, through the ASV 116 and into the annulus 110 (shown in FIG. 1) of the wellbore 102.

In some examples, when power is no longer supplied to the actuator assembly 224, either on demand from the power source 222 or due to a hazard cutting the electric line 120, the lack of power to the motor or linear actuator 210 causes the actuator arm 212 to move in a second direction, opposite the first direction, into the unactuated position in which it does not force the spring 216 in a compressed position via the movement of the valve flow tube 214. The elongation or release of the spring 216 moves the valve flow tube 214 which may cause the valve 218 to return to a closed position (shown in FIG. 2B). For example, the elongation or release of the spring 216 moves the valve flow tube 214 and can cause the flapper 219 to actuate to the closed position. In other words, absent the force of the actuator arm 212 moving the valve flow tube 214 to compress the spring 216 and force the valve 218 into the open position, the valve 218 returns to the closed position. In the closed position the valve 218 can prevent the flow of gas from the annulus to the surface. When the valve 218 is in the closed position, the gas in the annulus may be contained.

FIG. 2B depicts the ASV 116 in a closed position with the flapper 219 of valve 218 being in a closed position (i.e. a vertical position), thereby blocking the flow of gas through the ASV 116 from the annulus according to an aspect of the present disclosure.

In some examples, an additional ASV may be installed downhole in the wellbore 102 in combination with the ASV 116. The additional downhole ASV may complement the ASV 116 to ensure that the gas contents of the annulus above the additional downhole ASV remain shut in while the ASV 116 is in the closed position.

Figure 3:
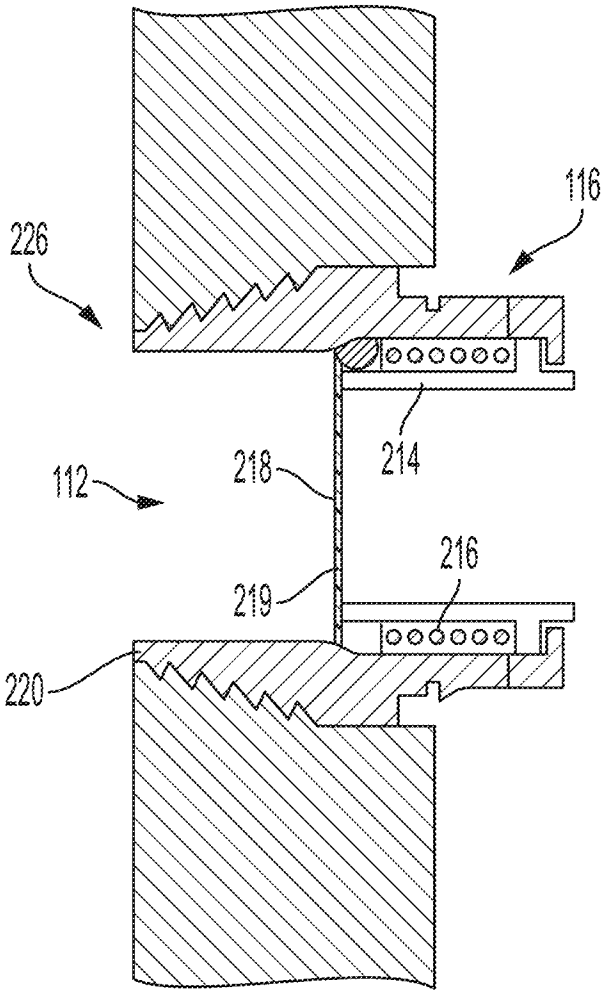
FIG. 3 is a schematic view of the ASV of FIGS. 2A-2B after removal of an actuator assembly according to an aspect of the present disclosure.

In some examples, such as the one shown in FIGS. 2A-2B, where the ASV 116 is housed in a casing spool 202, the ASV 116 can be retrieved by attaching a lubricator system to the spool 202 such that a retrieving tool in the lubricator system can be connected to either the actuator housing 208, the valve assembly 226, or both for retrieval. In some aspects, the valve assembly 226 may be retrievable independent from the actuator assembly 224, as shown in FIG. 3. As shown in FIG. 3, the actuator assembly 224 has been removed from the annulus outlet 112 while the valve assembly 226, including the spring 216, the valve flow tube 214, the valve housing 220 and the valve 218 remain therein. Further, as shown in FIG. 3, with the actuator assembly 224 removed, the spring 216 is again free to expand thus forcing the valve 218 including flapper 219 into the closed position.

In addition, the inductive coupler 206 may allow for simple disengagement of the electrical connection before retrieving the actuator assembly 224 and annulus line 204. Alternatively, in some aspects, the ASV 116 may not be retrieved independently from the actuator assembly 224.

Figure 4:
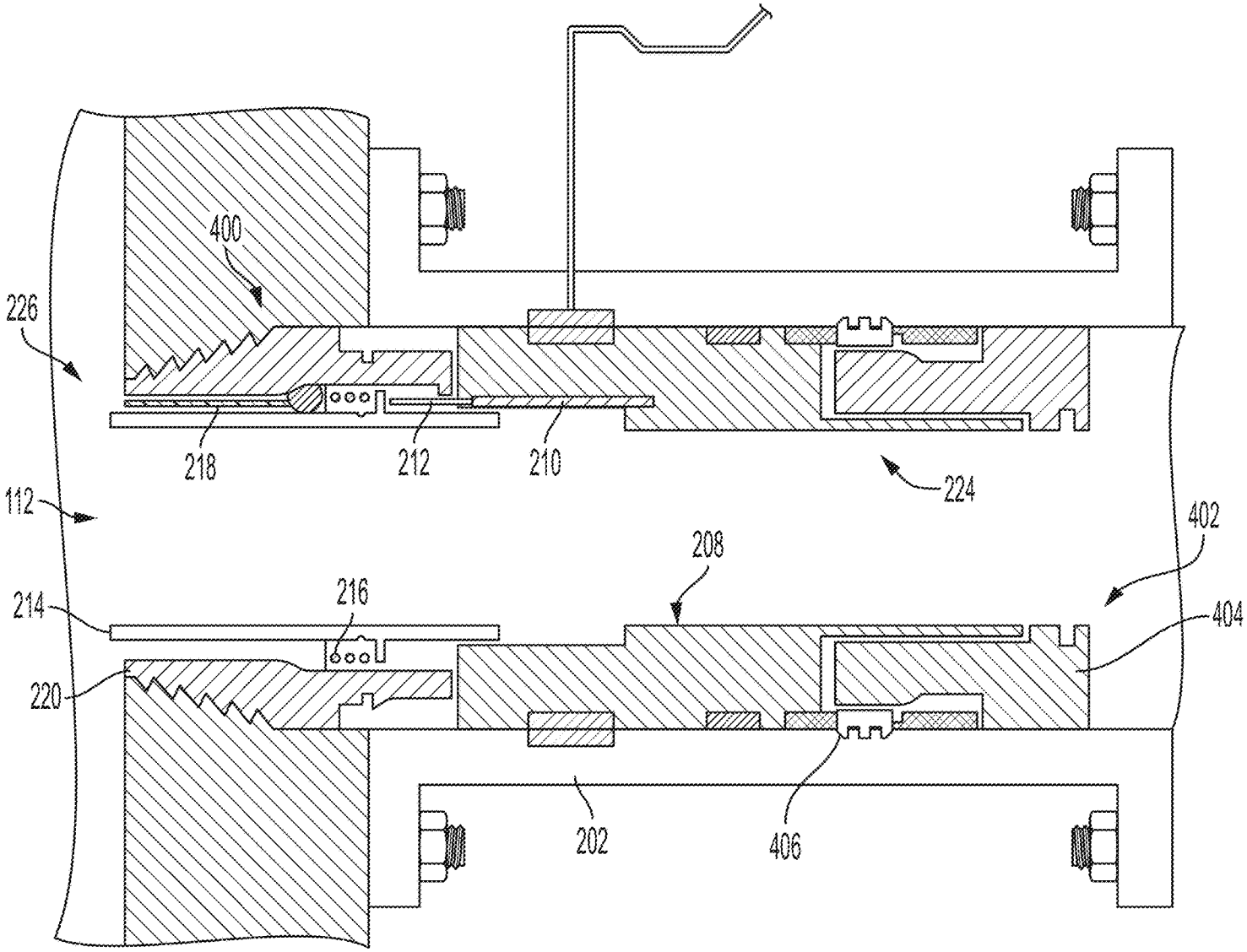
FIG. 4 is a schematic view of an ASV with a locking assembly according to an aspect of the present disclosure.

In some aspects, an ASV according to the present disclosure, for example the ASV 400 shown in FIG. 4, may also include a locking assembly 402. The ASV 400 may be positioned in an annulus outlet 112 according to an aspect of the present disclosure. The ASV 400 may include some or all of the features as described above with respect to ASV 116. For example, the ASV 400 may include the actuator assembly 224, including the actuator housing 208, the motor or linear actuator 210, the actuator arm 212; and the valve assembly 226 including the valve housing 220, the valve flow tube 214, the spring 216, and the valve 218. The locking assembly 402 may be a mechanical locking assembly and may include a lock housing 404 and a one or more teeth or projections 406 that extend from the lock housing 404. The one or more teeth or projections 406 may be sized and shaped to engage with one or more recesses in the casing spool 202. The engagement between the one or more teeth or projections 406 and the one or more recesses in the casing spool 202 may secure the actuator assembly 224 in place. The locking assembly 402 may retain the actuator assembly 224 in place as the motor or linear actuator 210 actuates the actuator arm 212.

Figure 5:
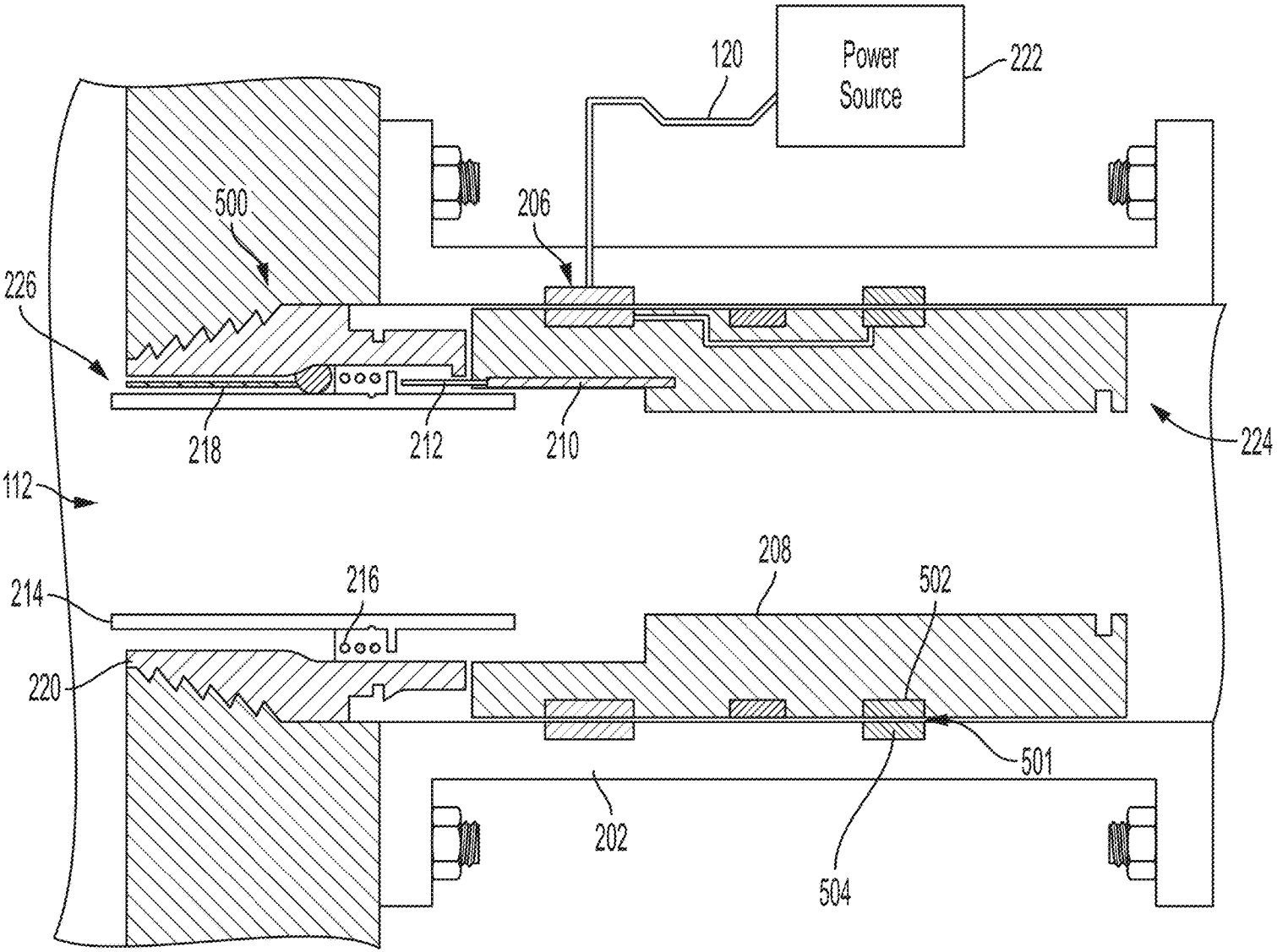
FIG. 5 is a schematic view of an ASV with an electromagnetic lock assembly according to an aspect of the present disclosure.

In some aspects, an ASV according to the present disclosure, for example an ASV 500 shown in FIG. 5, may also include an electromagnetic lock assembly 501. The ASV 500 may include some or all of the features as described above with respect to ASV 116. For example the ASV 500 may include the actuator assembly 224, including the actuator housing 208, the motor or linear actuator 210, the actuator arm 212; and the valve assembly 226 including the valve housing 220, the valve flow tube 214, the spring 216, and the valve 218. As shown in FIG. 5, the electromagnetic lock assembly 501 of the ASV 500 can include an electromagnetic lock 502 coupled to the ASV 500, for example but not limited to on the actuator assembly 224. In some aspects, the electromagnetic lock 502 may be housed in the actuator housing 208. The electromagnetic lock 502 may secure the actuator housing 208 to the spool 202 via the magnetic force between the electromagnetic lock 502 and the material of the spool 202. For example, the spool 202 may comprise a magnetic material. In some examples, the electromagnetic lock assembly 501 may also include an opposed magnet 504 coupled to the spool 202 to increase the strength of the electromagnetic lock 502, securing the actuator housing 208 to the spool 202 via the magnetic attraction between the electromagnetic lock 502 and the opposed magnet 504. In another example, the electromagnetic lock component positioning may be reversed, with the electromagnetic lock 502 housed in the spool 202, with magnetic attraction generated between the electromagnetic lock 502 and the material of the actuator assembly 224 or an opposed magnet 504 inserted in the actuator assembly 224. The electromagnetic lock 502 may be powered by the inductive coupler 206 communicatively coupled to the power source 222 via the electric line 120. The powered electromagnetic lock 502 may apply a force for locking the ASV 500 into place on the spool 202. For example, the spool 202 may be made of a magnetic material.

Figure 6:
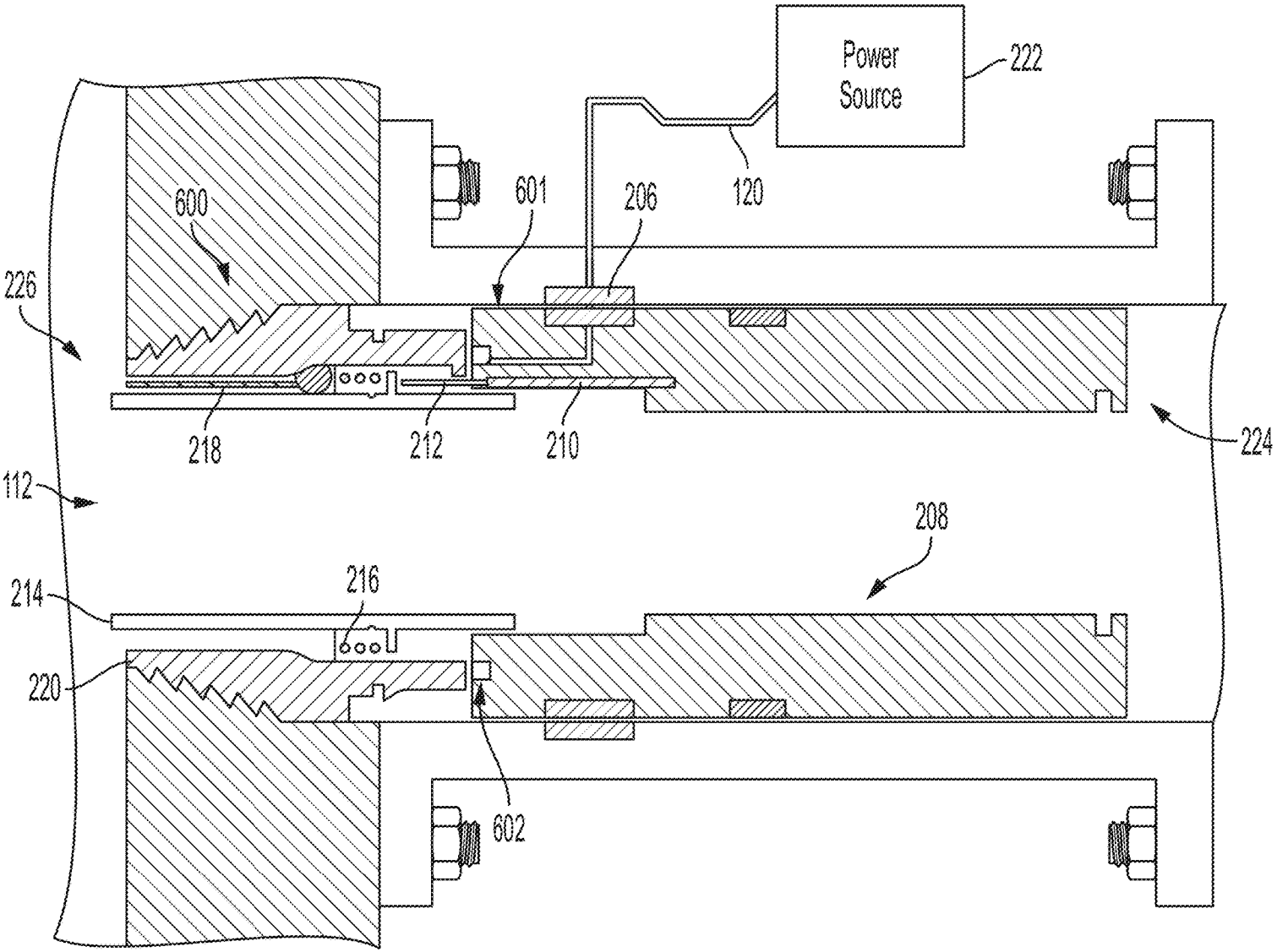
FIG. 6 is a schematic view of an ASV with an electromagnetic lock according to an aspect of the present disclosure.

Alternatively, an ASV according to aspects of the present disclosure, for example an ASV 600 shown in FIG. 6, may include an electromagnetic lock 602. The ASV 600 may include some or all of the features as described above with respect to ASV 116. For example the ASV 600 may have the actuator assembly 224, including the actuator housing 208, the motor or linear actuator 210, the actuator arm 212; and the valve assembly 226 including the valve housing 220, the valve flow tube 214, the spring 216, and the valve 218. An electromagnetic lock assembly 601 may lock the actuator assembly 224 (e.g., the actuator housing 208) to the valve assembly 226 (e.g. the valve housing 220). For example, as shown in FIG. 6, the electromagnetic lock assembly 601 can include an electromagnetic lock 602 coupled to the actuator housing 208 proximate to the valve assembly 226 for securing the actuator housing 208 to the valve housing 220 of the valve assembly 226. The ASV 600 may be powered by the inductive coupler 206 communicatively coupled to the power source 222 via the electric line 120. The powered electromagnetic lock 602 may thereby apply a force for locking the actuator housing 208 to the valve housing 220 as shown in FIG. 6. For example, the valve assembly 226 may be made of a magnetic material or include an insert of opposing magnetic material.

Figure 7:
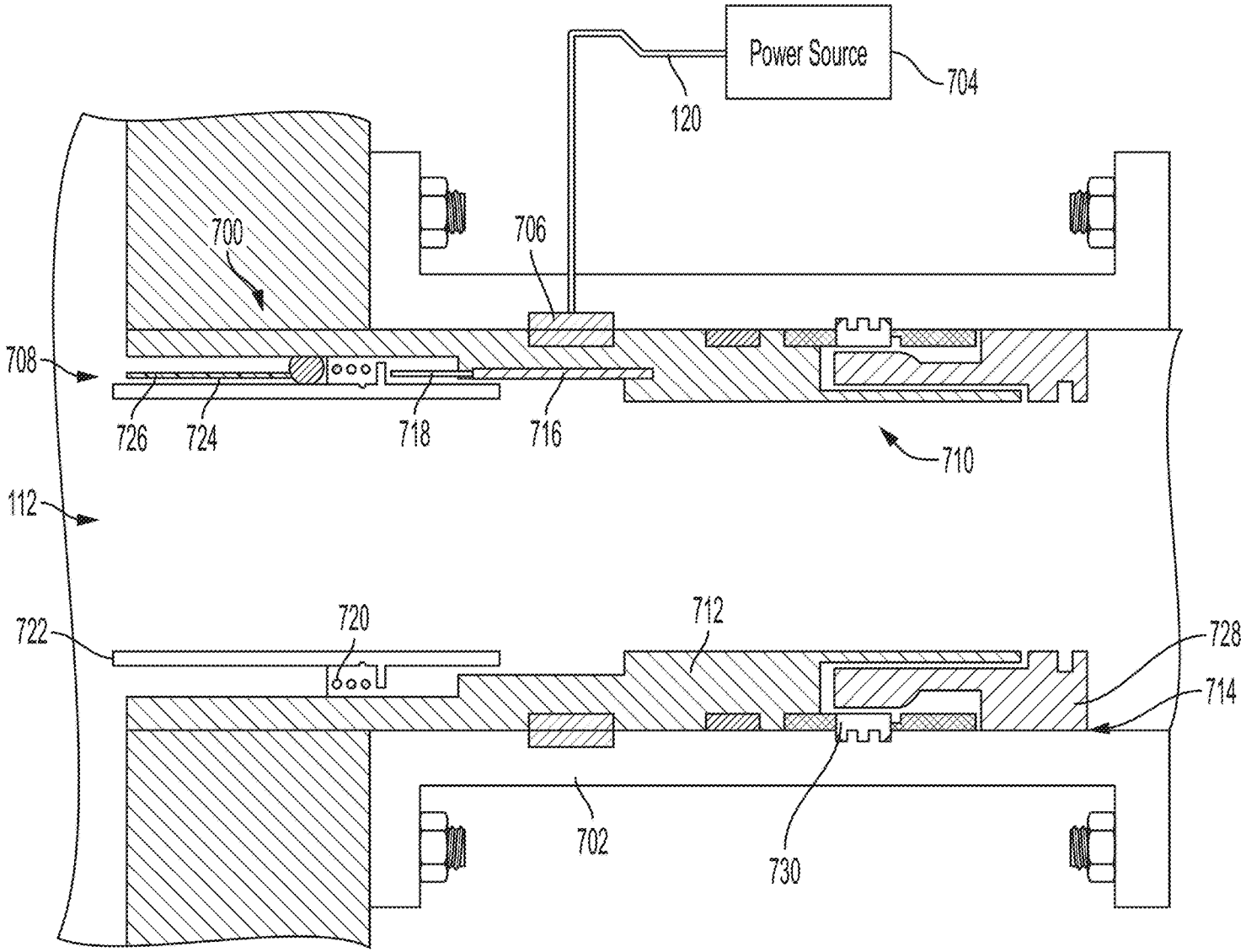
FIG. 7 is a schematic view of an ASV with a locking assembly according to an aspect of the present disclosure.

FIG. 7 is a schematic view of an ASV 700 according to aspects of the present disclosures. The ASV 700 may be positioned in the annulus outlet 112 and may include a valve assembly 708 that does not have a valve housing separate and distinct from an actuator housing 712 of an actuator assembly 710. Instead, in some aspects, as shown in FIG. 7, the ASV 700 may include an actuator housing 712 that includes a motor or linear actuator 716, an actuator arm 718, and a valve assembly 708. The valve assembly 708 may include a spring 720, a valve flow tube 722, and a valve 724 (shown in FIG. 7 as a valve comprising a flapper 726, though other suitable valve types may be used). The ASV 700 may not therefore provide for the valve assembly 708 being retrieved independently from the actuator assembly 710. The ASV 700 may actuate between an open and a closed positioned in the same or similar manner as that described with respect to the ASV 116 in FIG. 2A-2B. As described with respect to the ASV 116, the ASV 700 may also be powered by the inductive coupler 706 connected to a power source 704 via the electric line 120. The ASV 700 may also include a locking assembly 714. The ASV 700 may also include a locking assembly 714 may include a lock housing 728 and a one or more teeth or projections 730 that extend from the lock housing 728. The one or more teeth or projections 730 may be sized and shaped to engage with one or more recesses in the casing spool 702. The engagement between the one or more teeth or projections 730 and the one or more recesses in the casing spool 702 may secure the actuator assembly 710 into place.

Figure 8:
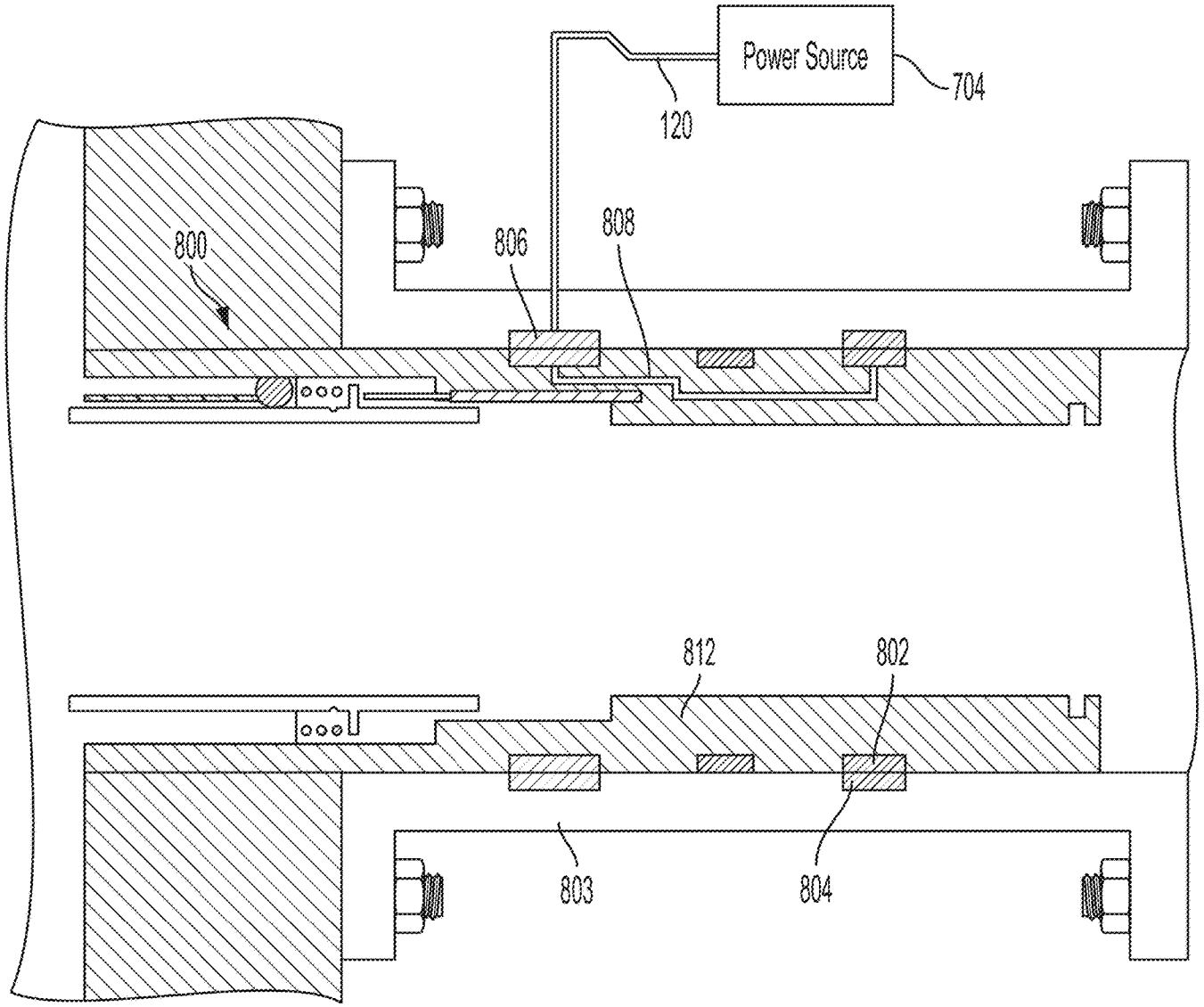
FIG. 8 is a schematic view of an ASV with an electromagnetic lock according to an aspect of the present disclosure.

In some examples, the locking assembly 714 of the ASV 700 may be replaced with a different locking assembly. For example, as shown in FIG. 8, the ASV 800 can include the same features as the ASV 700 but with a locking assembly that is an electromagnetic lock 802, as opposed to the locking assembly 714, for locking the ASV 800 to the spool 803 according to an aspect of the present disclosure. The electromagnetic lock 802 may be housed in or on the actuator housing 812. In some examples, the spool 803 may include an opposed magnet 804 to increase the strength of the electromagnetic lock 802. In another example, the electromagnetic lock component positioning could be reversed with the electromagnetic lock 802 housed in the spool 803 with magnetic attraction generated between the electromagnetic lock 802 and the material of the locking assembly 714 or an opposing magnet 804 positioned in the locking assembly 714. The electromagnetic lock 802 may be in electrical communication with an inductive coupler 806 via a power line 808. The inductive coupler 806 may be communicatively coupled to the power source 704 via the electric line 120. The ASV 800 may include some of the same features as described above with respect to ASV 700 and further may be moved to an open or closed position according to the method described in FIG. 2A with respect to the ASV 116.

Figure 9:
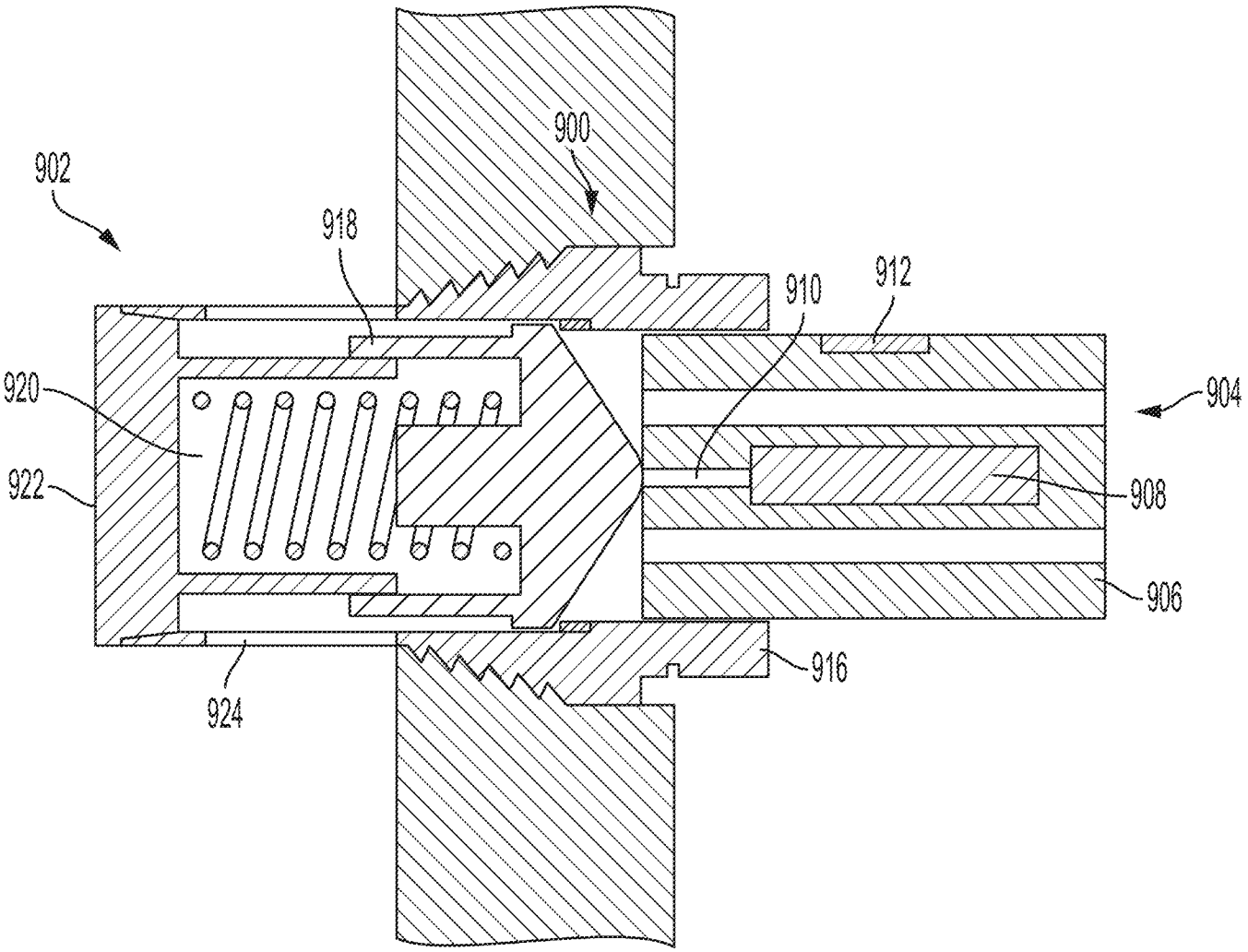
FIG. 9 is a schematic view of an ASV according to an aspect of the present disclosure.
Figure 10:
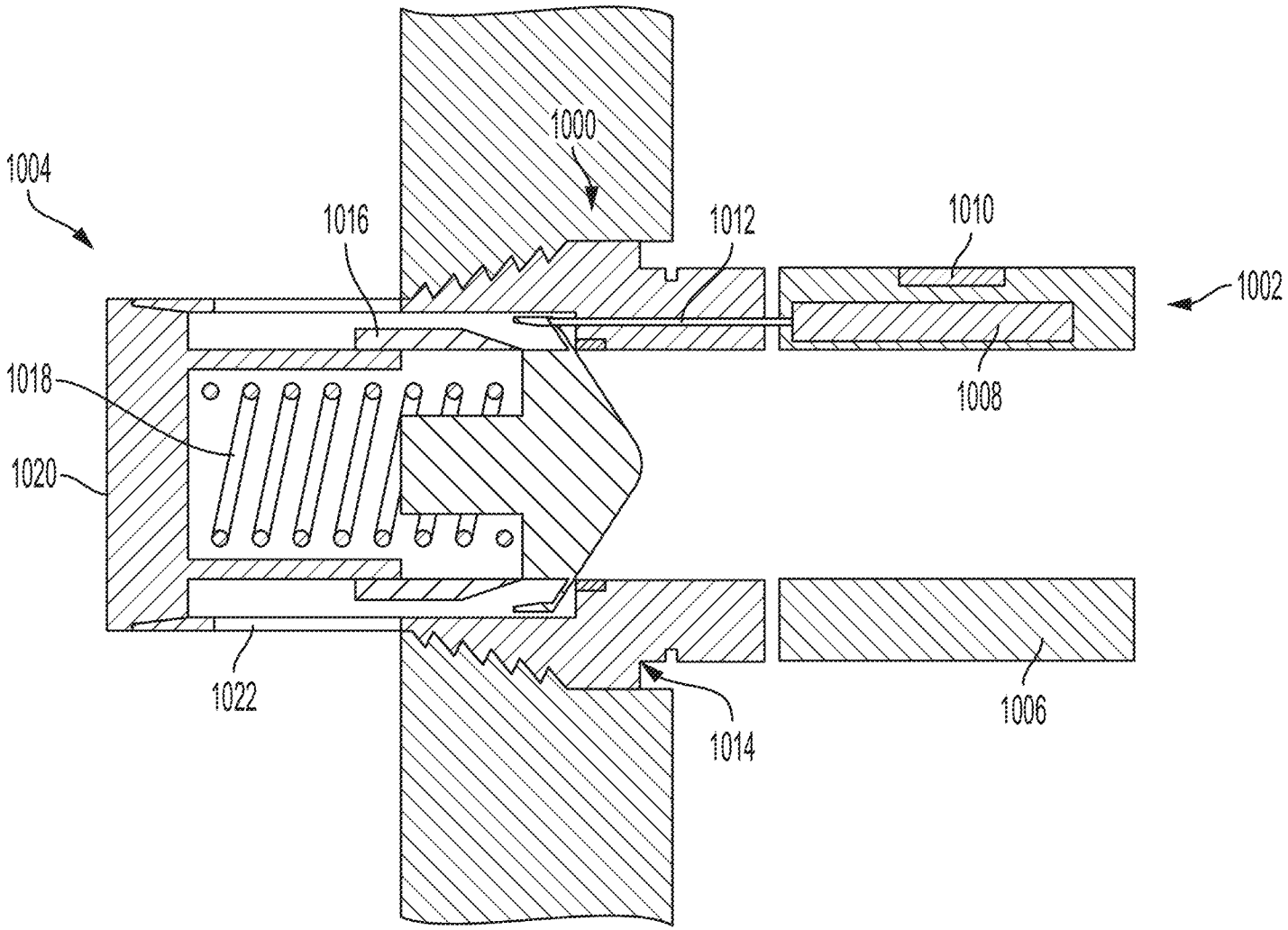
FIG. 10 is a schematic view of an ASV according to an aspect of the present disclosure.

FIG. 9 is a schematic view of an ASV 900 positioned according to aspects of the present disclosure. The ASV 900 includes a valve assembly 902 and an actuator assembly 904. The actuator assembly 904 may include an actuator housing 906, a motor or linear actuator 908, an actuator arm 910, and an inductive coupler 912 for powering the motor or linear actuator 908. The actuator assembly 904 may be partially positioned within the valve assembly 902. The valve assembly 902 may include a valve housing 916, a poppet valve 918, a spring 920, a base plate 922, and a gap 924 in the valve housing 916. The valve housing 916 may allow the components of the valve assembly 902 to remain in place if the actuator assembly 904 is retrieved. The gap 924 may allow the flow of gas through the ASV 900 when the ASV 900 moves into an open position.

The motor or linear actuator 908 may be an electric linear motor powered by a power source (not shown) at the surface via the inductive coupler 912 and a corresponding inductive coupler positioned adjacent the inductive coupler 912 at the wellhead. The inductive coupler 912 may be coupled to the power source via the corresponding inductive coupler and a power line (not shown) extending to the power source at the surface, for example as shown in FIG. 2A-2B with respect to the ASV 116. The power source may be an electric power source and the power line may be an electric line. The motor or linear actuator 908 may actuate or move the actuator arm 910 for actuating the valve assembly 902 between an open position and a closed position. In response to the motor or linear actuator 908 moving the actuator arm 910 in a first direction towards the poppet valve 918, the actuator arm 910 contacts the poppet valve 918 applying a force in a first direction towards the spring 920. The force of the actuator arm 910 may force the poppet valve 918 in the first direction, compressing the spring 920 against the base plate 922. The poppet valve 918 may be forced in the first direction such that the poppet valve 918 no longer blocks the flow of gas through the ASV 900 via the gap 924 in the ASV 900.

According to additional aspects of the present disclosure, an ASV 1000 may include an actuator assembly 1002 and a valve assembly 1004. The actuator assembly 1002 may include an actuator housing 1006, a motor or linear actuator 1008, and an inductive coupler 1010 (with a corresponding inductive coupled positioned adjacent the inductive coupler 1010 at the wellhead). The actuator arm 1012 may be included in the valve assembly 1004, as opposed to the actuator assembly as shown in other aspects of this disclosure. The valve assembly 1004 may also include a valve housing 1014, a poppet valve 1016, a spring 1018, a base plate 1020, and a gap 1022 in the valve housing 1014. The gap 1022 may allow the flow of gas through the ASV 1000 when the ASV 1000 moves into an open position. The actuator arm 1012 may be positioned within the valve housing 1014.

The actuator assembly 1002 may be positioned adjacent to the valve housing 1014, rather than within the valve housing 1014 (as depicted in FIG. 9). The motor or linear actuator 1008 may be powered by a power source (not shown) via a power line (not shown) between power sources and the inductive coupler 1010. The power source may be an electric power source and the power line may be an electric line. The motor or linear actuator 1008 may be positioned in the actuator housing 1006 proximate to the actuator arm 1012 positioned in the valve housing 1014, such that the motor or linear actuator 1008 may actuate or move the actuator arm 1012. The ASV 1000 may actuate from an open position to a closed position in the same manner as described in FIG. 9 with respect to the ASV 900.

Figure 11A:
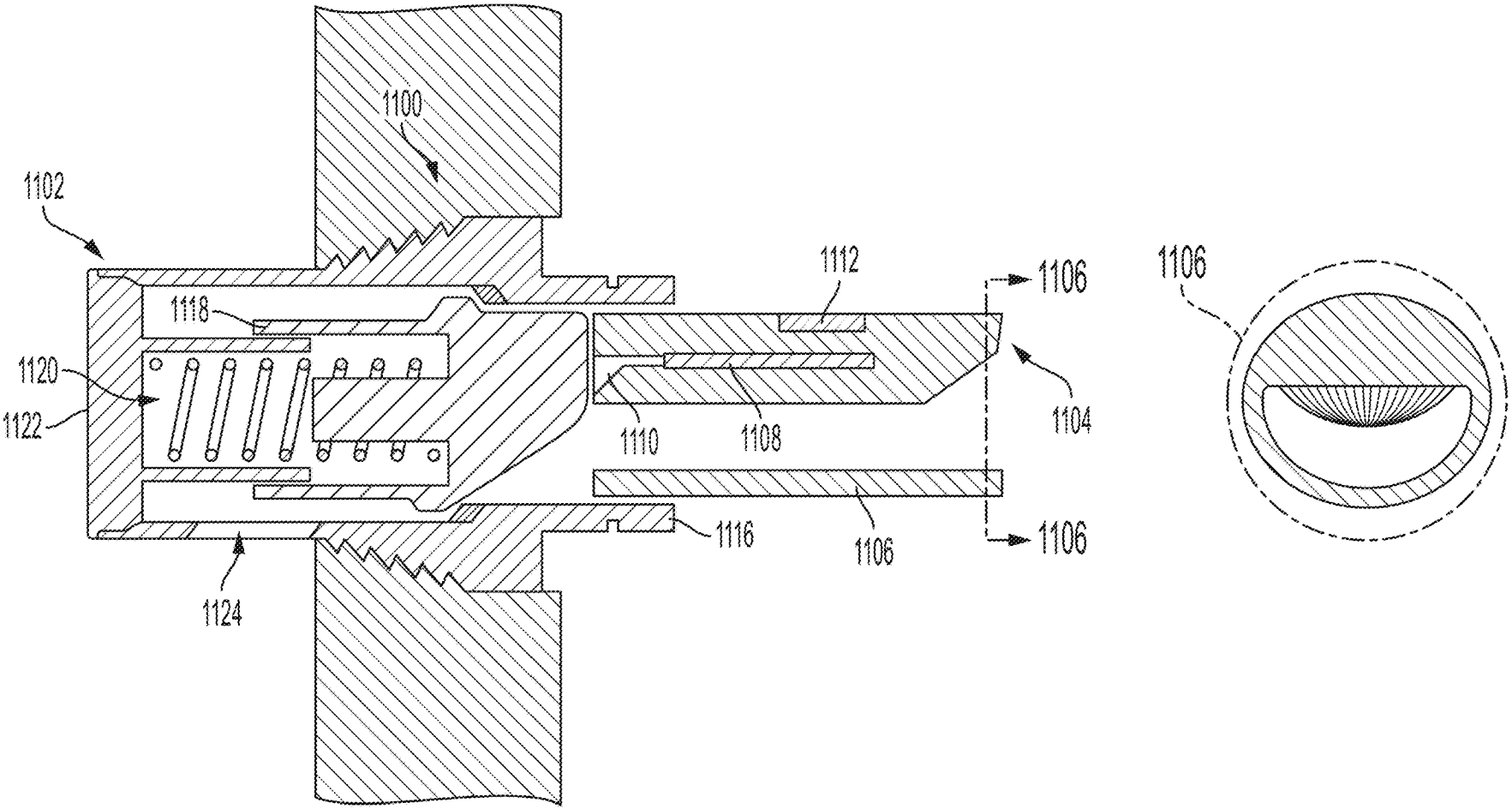
FIG. 11A is a schematic view of an ASV in a closed position according to an aspect of the present disclosure.
Figure 11B:
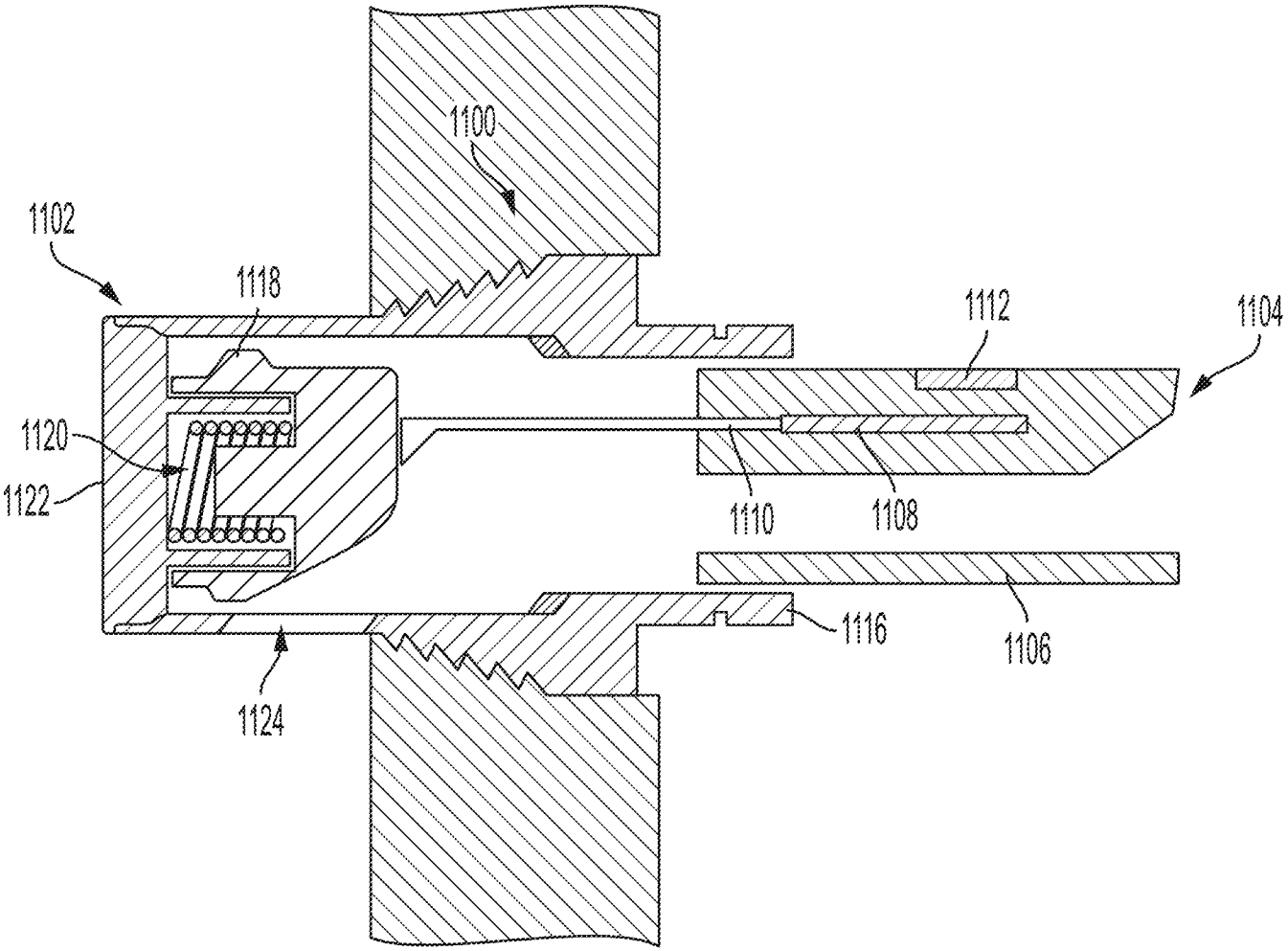
FIG. 11B is a schematic view of an ASV in an open position according to an aspect of the present disclosure.

In some aspects of the present disclosure, as shown in FIGS. 11A-11B, an ASV 1100 may include an actuator assembly 1104 and a valve assembly 1102 having different configurations than those provided in the aspects above. The ASV 1100 is shown in a closed position in FIG. 11A and an open position in FIG. 11B. As shown in FIGS. 11A-11B, the actuator assembly 1104 may include an actuator housing 1106, a motor or linear actuator 1108, an inductive coupler 1112, and an actuator arm 1110. The valve assembly 1102 may include a valve housing 1116, a poppet valve 1118, a spring 1120, a base plate 1122, and a gap 1124 in the valve housing 1116. The ASV 1100 may be powered by a power source at the surface via a power line coupled between the power source and an inductive coupler on a portion of the wellhead adjacent the inductive coupler 1112 on the ASV 1100. The actuator assembly 1104 may be positioned within the valve housing 1116. The actuator housing 1106 provides a cross section depicted in FIG. 11A that differs from the cross section of actuator housings in other examples. In the open position depicted FIG. 11B depicts the ASV 1100 in an open position with the actuator arm 1110 actuating the poppet valve 1118, causing the spring 1120 to compress against the base plate 1122, thereby allowing the flow of gas through the ASV 1100 via the gap 1124 in the valve housing 1116 into the annulus.

Figure 12:
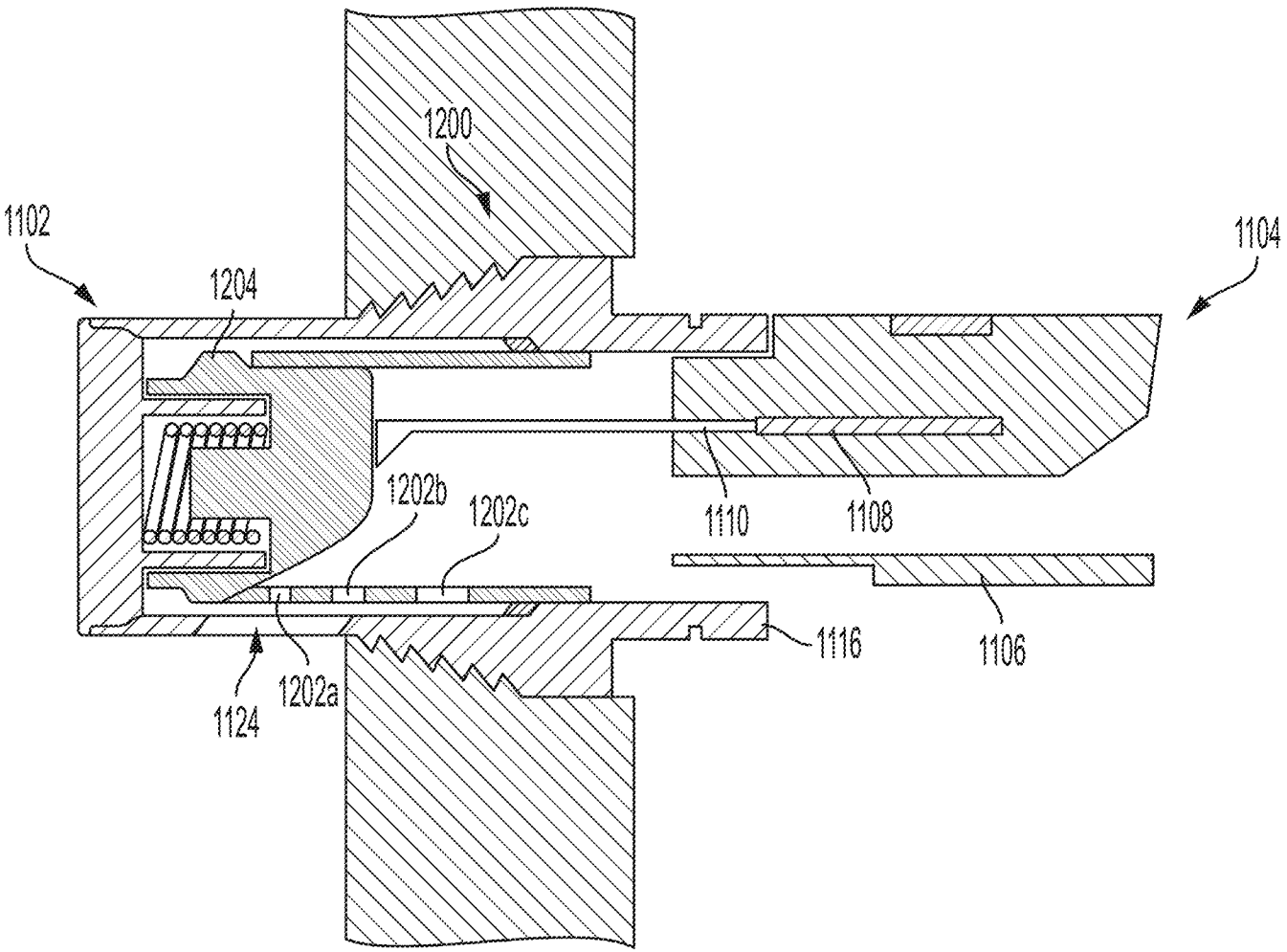
FIG. 12 is a schematic view of an ASV with a poppet valve for providing a choking function according to an aspect of the present disclosure.

In some aspects of the present disclosure, such as the one shown in FIG. 12, an ASV 1200 may include a poppet valve 1204 with multiple openings 1202*a-c* in the valve housing 1116 to provide for variations in the amount of gas permitted to pass through the ASV. The ASV 1200 may include the same or similar features as those described above with respect to the ASV 1100, for example the actuator assembly

1104 of the ASV 1100 may also be used in the ASV 1200. As shown in FIG. 12, the position of the poppet valve 1204 in the valve assembly 1102 may determine which of the openings 1202*a-c* is positioned over the gap 1124 to define the opening through which gas may pass. FIG. 12 depicts the ASV 1200 in an open position. The motor or linear actuator 1108 may incrementally actuate the actuator arm 1110 to move the poppet valve 1204 in a first direction to progressively open or close the ASV 1200 via the positioning of the openings 1202*a-c* such that the size of the opening defined by the overlapping of one of the openings 1202*a-c* and the gap 1124 in the valve housing 1116 is incrementally adjusted. The flow of gas through the ASV 1200 may therefore be controlled as the gas moves through the gap 1124 via the alignment of a select opening 1202*a-c* with the gap 1124. The ASV 1200 may be powered in a manner similar to that described relative to the ASV 116, via an inductive coupler, a power line, and a power source at the surface. The power source may be an electric power source.

Figure 13:
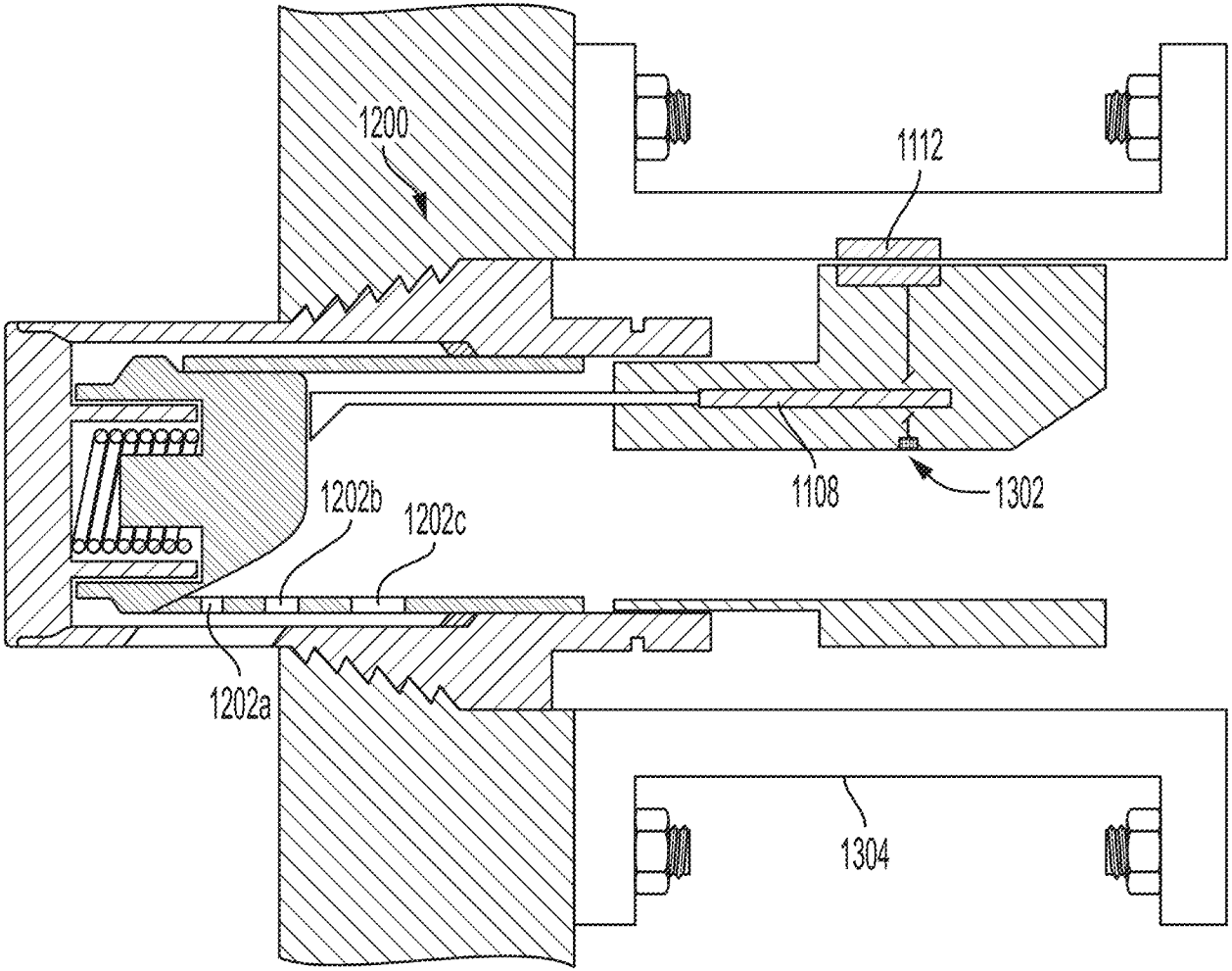
FIG. 13 is a schematic view of an ASV with sensors according to an aspect of the present disclosure.

In some examples, such as the one shown in FIG. 13, the ASV 1200 may include one or more sensors 1302 according to an aspect of the present disclosure. The sensors 1302 may be a component of the motor or linear actuator 1108. Alternatively, the sensors 1302 may be placed in various locations throughout the ASV 1200. The sensors 1302 may transmit sensor data to a control unit on the surface via the inductive coupler 1112. The inductive coupler 1112 may also power the ASV 1200 (including sensors 1302) via a power source (e.g. an electric power source) at the surface that is coupled to the inductive coupler 1112 via a power line, as described with reference to the ASV 116. Examples of sensors 1302 can include pressure and temperature sensors, though other sensors may be used. In some aspects, the use of multiple pressure sensors in multiple locations may allow for a calculation of flow rate. The ASV 1200 may be positioned within a casing spool 1304.

Figure 14:
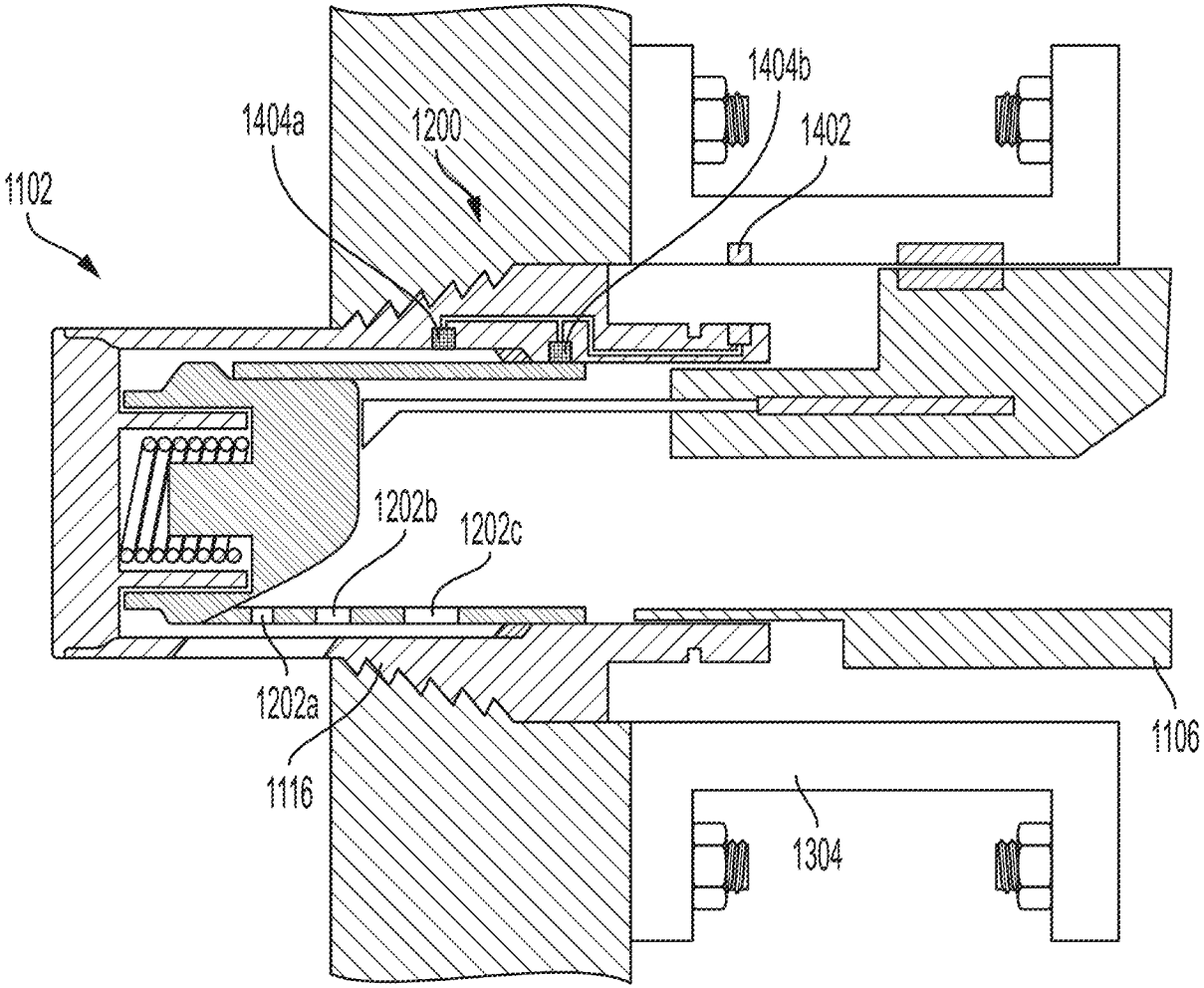
FIG. 14 is a schematic view of an ASV with a secondary inductive coupler and sensors according to an aspect of the present disclosure.

In some examples, such as the one shown in FIG. 14, the ASV 1200 may include a secondary inductive coupler 1402 in addition to the inductive coupler 1112. The secondary inductive coupler 1402 may be positioned within the valve housing 1116. The secondary inductive coupler 1402 may receive power from the power unit at the surface via a power line which may be the same or an additional power line as the one coupling the inductive coupler 1112 to the power source. Sensors 1404*a-b* may also be positioned within the valve housing 1116. The sensors 1404*a-b* may receive power from the secondary inductive coupler 1402 and may transmit sensor data to the control unit on the surface via the secondary inductive coupler 1402. In the event of a safety incident or removal of the actuator assembly 1104, remedial connection to the sensors 1404*a-b* via the secondary inductive coupler 1402 may be possible. The secondary inductive coupler 1402 may include a first component located on the casing spool 1304 and a second component located on the valve assembly 1102, as depicted in FIG. 14. Alternatively, the secondary inductive coupler 1402 may include a first component located on the actuator housing 1106 and a second component located on the valve assembly 1102.

Figure 15:
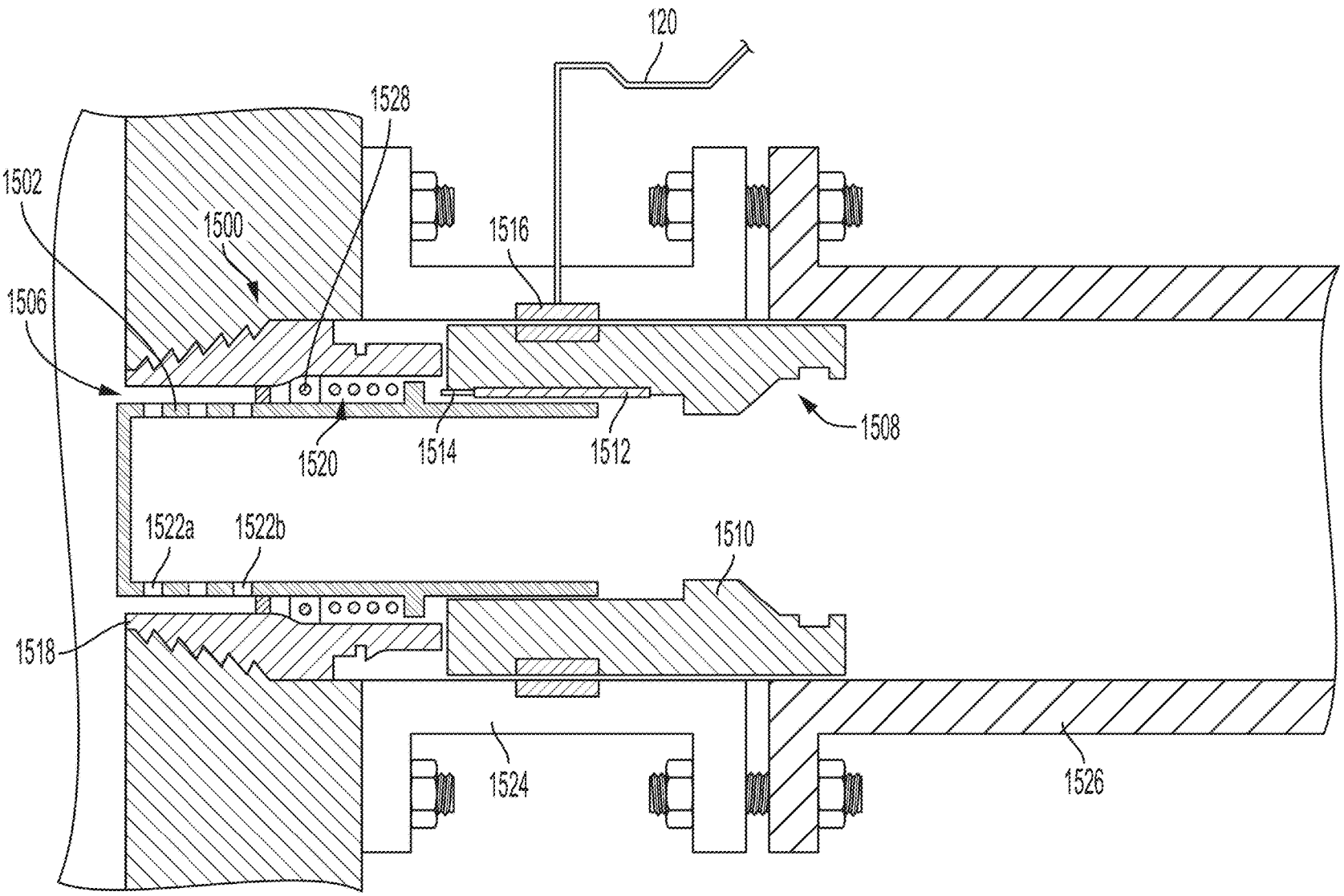
FIG. 15 is a schematic view of an ASV with a choke valve according to an aspect of the present disclosure.

FIG. 15 is a schematic view of an ASV 1500 according to aspects of the present disclosure in which the ASV 1500 provides for a choking effect in its control of gas passing through the ASV. FIG. 15 depicts the ASV 1500 in a closed position with a valve assembly 1506 that is a choke valve assembly according to aspects of the present disclosure. The ASV 1500 also includes an actuator assembly 1508. The actuator assembly 1508 may include an actuator housing 1510, a motor 1512, an actuator arm 1514, and an inductive coupler 1516 for powering the motor 1512. The valve assembly 1506 may include a valve housing 1518, a choke valve 1502, and a spring 1520. The valve housing 1518 may provide for the valve assembly 1506 to be retrieved independently from the actuator assembly 1508. The choke valve 1502 may include openings 1522*a-b* through which gas may flow when the ASV 1500 is in an open position. In some examples, the ASV 1500 may be located within a casing spool 1524 as shown in FIG. 15, or in an annulus line 1526.

The motor 1512 may be an electric linear motor powered by a power source at the surface via the inductive coupler 1516. The inductive coupler 1516 may be coupled to the power source via the electric line 120. The motor 1512 may actuate or move the actuator arm 1514 for actuating the valve assembly 1506 between an open and closed position. In response to the motor 1512 moving the actuator arm 1514 in a first direction towards the choke valve 1502, the actuator arm 1514 contacts the choke valve 1502 applying a force in the first direction towards the spring 1520. The force of the actuator arm 1514 may force the choke valve 1502 in the first direction, compressing the spring 1520 against an extension 1528 of the valve housing. The motor 1512 may incrementally actuate the actuator arm 1514 to move the choke valve 1502 in a first direction to progressively open or close the ASV 1500 such that the available flow area, defined by which of the openings 1522*a-b* is exposed to the annulus of the wellbore 102, is controlled by the position of the choke valve 1502.

In some aspects, apparatuses, systems, and methods for annular safety valves that may be positioned at a surface of a well system and powered electrically via a power source at the surface, are provided according to one or more of the following examples:

Example #1: A wellhead system at a surface of a wellbore can include a power source positionable at the surface of the wellbore, an electric line, and an annular safety valve. The annular safety valve may be positionable in an annulus outlet of the wellhead system. The annular safety valve can include an inductive coupler. The electric line may couple the inductive coupler to the power source for providing power to the annular safety valve.

Example #2: The wellhead system of Example #1 may feature the annular safety valve being positionable at least partially within a spool of the wellhead system.

Example #3: The wellhead system of any of Examples #1-2 may feature the annular safety valve further including an actuator assembly and a valve assembly.

Example #4: The wellhead system of any of Examples #1-3 may feature a first inductive coupler component of the inductive coupler that is positionable on the spool and a second inductive coupler component of the inductive coupler that is positionable on the actuator assembly. The first inductive coupler component may receive power from the power source via the electric line and may inductively transmit the power to the second inductive coupler component.

Example #5: The wellhead system of any of Examples #1-4 may feature the actuator assembly including an actuator housing, a linear actuator positionable within the actuator housing and configurable to receive power from inductive coupler, and an actuator arm positionable within the actuator housing and configurable to be actuated by the linear actuator.

Example #6: The wellhead system of any of Examples #1-5 may feature the valve assembly including a valve flow tube for compressing a spring in response to the actuator arm contacting the valve flow tube for actuating a valve between a closed position and an open position.

Example #7: The wellhead system of any of Examples #1-6 may feature a valve housing for housing the valve flow tube, spring, and valve.

Example #8: The wellhead system of any of Examples #1-7 may feature the annular safety valve further including at least one sensor.

Example #9: The wellhead system of any of Examples #1-8 may feature the at least one sensor being positioned within a flow path of the annular safety valve for monitoring conditions in the annulus outlet.

Example #10: The wellhead system of any of Examples #1-9 may feature thee valve assembly including a plurality of openings for controlling an amount of a gas that may pass through the annular safety valve.

Example #11: An annular safety valve positioned on a surface of a well system in an annulus outlet may include an actuator assembly communicatively coupled to an inductive coupler configured to receive electrical power from a power source, a valve assembly coupled to the actuator assembly, and a spring. The actuator assembly may include an actuator housing, a linear actuator positioned within the actuator housing for receiving electrical power from the inductive coupler, and an actuator arm positioned within the actuator housing for actuating in response to the linear actuator. The valve assembly may include a valve positionable in a closed position to prevent, or in an open position to allow, flow of gas from flowing through the annular safety valve and a valve flow tube including a tube body and a projection. The projection may be positionable between a first end of a spring and the actuator arm and configured to move in a first direction in response to the actuation of the actuator arm. The spring may actuate the valve between an open position and a closed position in response to the valve flow tube moving in the first direction.

Example #12: The annular safety valve of Example #11 may feature the annular safety valve being positionable within a spool or annulus line of the well system.

Example #13: The annular safety valve of any of Examples #11-12 may feature the actuator assembly being de-coupleable from the valve assembly for being independently retrieved from the well system separate from the valve assembly.

Example #14: The annular safety valve of any of Examples #11-13 may feature a locking system for securing the annular safety valve onto the spool.

Example #15: The annular safety valve of any of Examples #11-14 may feature the locking system including a mechanical locking assembly.

Example #16: The annular safety valve of any of Examples #11-15 may feature the locking system including an electromagnetic lock assembly including a magnet with a magnetic flux positionable on one of the spool or the annular safety valve for securing the annular safety valve to the spool.

Example #17: The annular safety valve of any of Examples #11-16 may feature the locking system including an opposed magnet positionable on the other of the spool or the annular safety valve for increasing a strength of a magnetic force securing the annular safety valve to the spool.

Example #18: The annular safety valve of any of Examples #11-17 may feature the electromagnetic lock assembly being coupled to the inductive coupler via a power line for powering the electromagnetic lock assembly.

Example #19: The annular safety valve of any of Examples #11-18 may feature at least one sensor electronically coupled to the inductive coupler.

Example #20: A method of controlling a flow of gas through an annular safety valve positioned at a surface of a well system can include providing an annular safety valve. The annular safety valve can include an inductive coupler coupled to an electric power source at a surface of the well system via an electric line, a valve assembly, an actuator assembly, and a linear actuator coupled to the inductive coupler. The method can include transmitting power from the electric power source to the annular safety valve. The method can include actuating the annular safety valve from a closed position in which gas may not pass through an annular safety valve to an open position in which a first amount of gas may pass through the annular safety valve.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A wellhead system at a surface of a wellbore comprising:

a power source positionable at the surface of the wellbore;

an electric line; and an annular safety valve positionable in an annulus outlet of the wellhead system, the annular safety valve comprising:

an inductive coupler, the electric line coupling the inductive coupler to the power source for providing power to the annular safety valve;

an actuator assembly communicatively coupled to the inductive coupler; and a valve assembly coupled to the wellhead system, the actuator assembly being retrievably coupled to the valve assembly such that the actuator assembly is de-coupleable from the valve assembly, the valve assembly configured to remain downhole while the actuator assembly is decoupled from the valve assembly, wherein a valve of the valve assembly is configured to be positionable in a closed position to prevent flow of gas from flowing through the annular safety valve in response to the actuator assembly being decoupled from the valve assembly.

2. The wellhead system of claim 1, wherein the annular safety valve is positionable at least partially within a spool of the wellhead system.

3. The wellhead system of claim 2, wherein a first inductive coupler component of the inductive coupler is positionable on the spool, wherein a second inductive coupler component of the inductive coupler is positionable on the actuator assembly, and wherein the first inductive coupler component receives power from the power source via the electric line and inductively transmits the power to the second inductive coupler component.

4. The wellhead system of claim 3, wherein the actuator assembly comprises an actuator housing, a linear actuator positionable within the actuator housing and configurable to receive power from the inductive coupler, and an actuator arm positionable within the actuator housing and configurable to be actuated by the linear actuator.

5. The wellhead system of claim 4, wherein the valve assembly comprises a valve flow tube for compressing a spring in response to the actuator arm contacting the valve flow tube for actuating the valve between the closed position and an open position.

6. The wellhead system of claim 5, further comprising a valve housing for housing the valve flow tube, spring, and valve.

7. The wellhead system of claim 2, wherein the annular safety valve further comprises at least one sensor.

8. The wellhead system of claim 7, wherein the at least one sensor is positioned within a flow path of the annular safety valve for monitoring conditions in the annulus outlet.

9. The wellhead system of claim 1, wherein the valve assembly includes a plurality of openings for controlling an amount of a gas that may pass through the annular safety valve.

10. The wellhead system of claim 1, further comprising:

a lubricator system coupleable to the annulus outlet and configured to de-couple the actuator assembly from the valve assembly.

11. An annular safety valve positionable on a surface of a well system in an annulus outlet, the annular safety valve comprising:

an actuator assembly communicatively coupled to an inductive coupler configurable to receive electrical power from a power source, the actuator assembly comprising:

an actuator housing;

a linear actuator positioned within the actuator housing for receiving electrical power from the inductive coupler;

an actuator arm positioned within the actuator housing for actuating in response to the linear actuator; and a valve assembly, wherein the actuator assembly is retrievably coupled to the valve assembly such that the actuator assembly is de-coupleable from the valve assembly and the valve assembly is configured to remain downhole while the actuator assembly is decoupled from the valve assembly, the valve assembly comprising:

a valve positionable in a closed position to prevent, or in an open position to allow, flow of gas from flowing through the annular safety valve; and a valve flow tube including a tube body and a projection, wherein the projection is positionable between a first end of a spring and the actuator arm and configured to move in a first direction in response to the actuation of the actuator arm; and a spring for actuating the valve between the open position and the closed position in response to the valve flow tube moving in the first direction, wherein the valve assembly is configured to cause the spring to actuate the valve to the closed position in response to the actuator assembly being decoupled from the valve assembly.

12. The annular safety valve of claim 11, wherein the annular safety valve is positionable within a spool or annulus line of the well system.

13. The annular safety valve of claim 12, further comprising a locking system for securing the annular safety valve onto the spool.

14. The annular safety valve of claim 13, wherein the locking system comprises a mechanical locking assembly.

15. The annular safety valve of claim 13, wherein the locking system comprises an electromagnetic lock assembly comprising a magnet with a magnetic flux positionable on one of the spool or the annular safety valve for securing the annular safety valve to the spool.

16. The annular safety valve of claim 15, wherein the locking system further comprises an opposed magnet positionable on the other of the spool or the annular safety valve for increasing a strength of a magnetic force securing the annular safety valve to the spool.

17. The annular safety valve of claim 15 wherein the electromagnetic lock assembly is coupled to the inductive coupler via a power line for powering the electromagnetic lock assembly.

18. The annular safety valve of claim 11, further comprising at least one sensor electronically coupled to the inductive coupler.

19. The annular safety valve of claim 11, wherein the actuator assembly is configured to be de-coupleable from the valve assembly via a lubricator system that is coupleable to the annulus outlet.

20. A method of controlling a flow of gas through an annular safety valve positioned at a surface of a well system, the method comprising:

providing an annular safety valve comprising:

an inductive coupler coupled to an electric power source at a surface of the well system via an electric line;

a valve assembly coupled to an annulus outlet in the well system;

an actuator assembly retrievably coupled to the valve assembly;

a linear actuator coupled to the inductive coupler;

transmitting power from the electric power source to the annular safety valve;

actuating the annular safety valve from a closed position in which gas may not pass through the annular safety valve to an open position in which a first amount of gas may pass through the annular safety valve;

decoupling the actuator assembly from the valve assembly, wherein the valve assembly remains coupled to the annulus outlet while the actuator assembly is de-coupled from the valve assembly; and in response to decoupling the actuator assembly from the valve assembly, actuating a valve of the valve assembly to a closed position to prevent flow of gas from flowing through the annular safety valve.

* * * * *